United States Patent [19]

Hungerford

[11] 4,358,147

[45] Nov. 9, 1982

[54] MOUNTING AND ACTUATING APPARATUS FOR TONGS

[75] Inventor: Emory D. Hungerford, Milwaukie, Oreg.

[73] Assignee: ESCO Corporation, Portland, Oreg.

[21] Appl. No.: 210,368

[22] Filed: Nov. 25, 1980

[51] Int. Cl.[3] ..... B66C 3/16

[52] U.S. Cl. ..... 294/88; 294/106; 294/111

[58] Field of Search ..... 294/67 BC, 70, 88, 106, 294/107, 111, 112; 37/183 R, 186–188; 414/624, 626, 739

[56] References Cited

U.S. PATENT DOCUMENTS

| | | | |
|---|---|---|---|
| 1,371,291 | 3/1921 | Atkinson | 37/186 |
| 1,564,041 | 12/1925 | Windecker | 37/187 |
| 2,412,845 | 12/1946 | Stevens | 294/107 X |
| 2,573,667 | 10/1951 | Tourneau | 294/107 |
| 3,972,431 | 8/1976 | Fischer | 294/106 X |
| 4,023,848 | 5/1977 | Bennett | 294/88 |

FOREIGN PATENT DOCUMENTS

| | | | |
|---|---|---|---|
| 530868 | 8/1954 | Belgium | 294/70 |
| 445776 | 2/1968 | Switzerland | 294/88 |
| 381598 | 1/1971 | U.S.S.R. | 294/88 |
| 474490 | 12/1975 | U.S.S.R. | 294/88 |

*Primary Examiner*—Johnny D. Cherry

*Attorney, Agent, or Firm*—Tilton, Fallon, Lungmus & Chestnut

[57] ABSTRACT

A mounting and actuating apparatus for the tongs of a grapple wherein a pair of pulleys carrying the tongs are interconnected by cable means extending between the pulleys in generally figure eight configuration, one embodiment teaching driving one pulley by a fluid pressure cylinder positioned between the pulleys and utilizing axially offset cable links, the other embodiment including a multiplying linkage between the two tongs.

5 Claims, 9 Drawing Figures

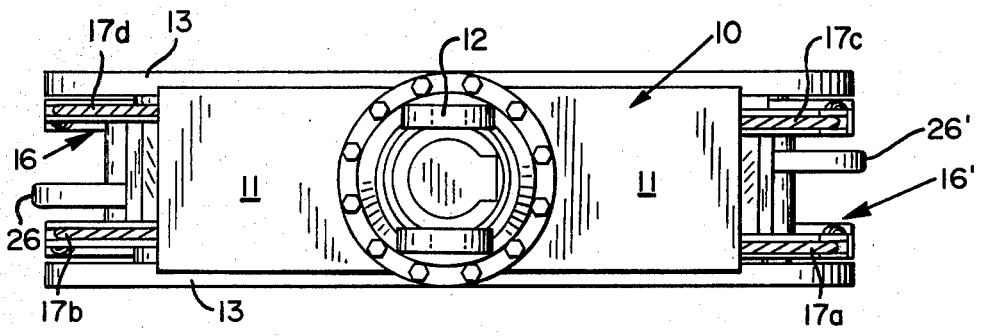
FIG. 2
FIG. 3
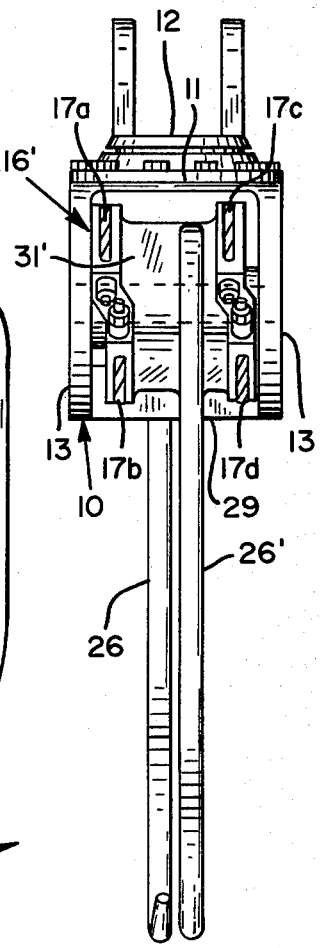
FIG. 1
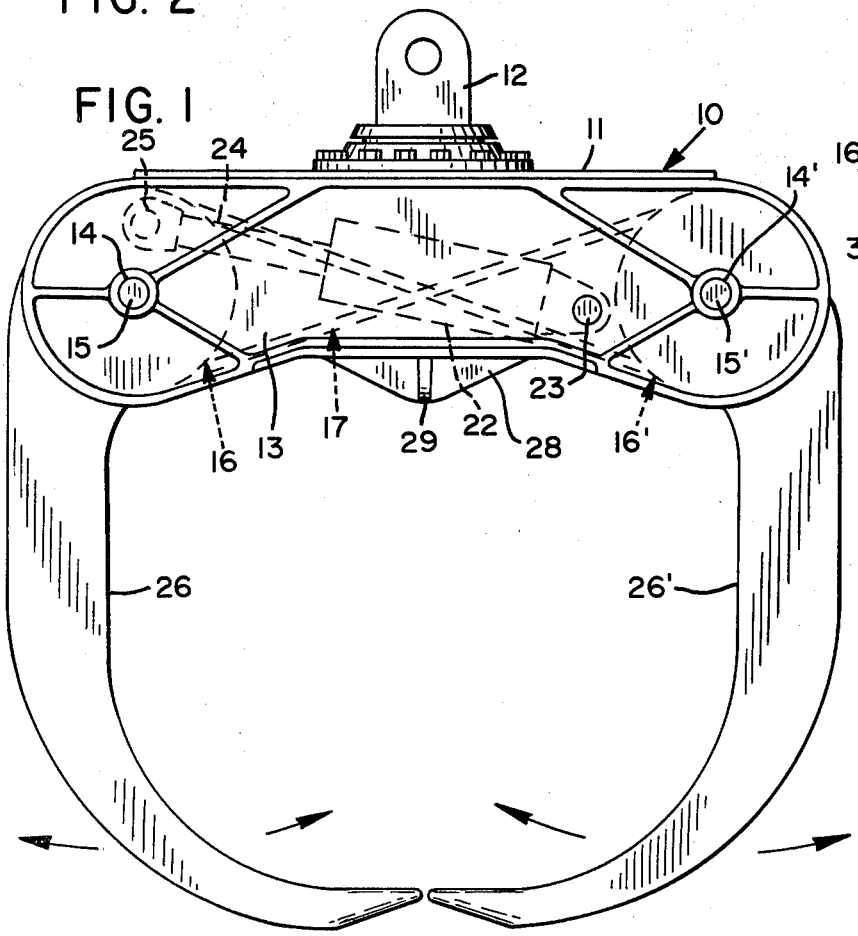

MOUNTING AND ACTUATING APPARATUS FOR TONGS

One particular advantageous environment for the invention is in connection with grapples employed with apparatus for skidding logs. Heretofore the grapples have employed expensive structurally rigid tension/-compression links which require floating tong pivot points and additionally machined and bushed pin joints. When it is considered that the environment is rugged and primitive, the employment of complicated and sometimes delicate parts can be a real disadvantage. The disadvantages of construction and use are both avoided through the practice of the invention.

According to the invention, the tong mounting and actuating apparatus employs a pair of pulley means each rotatably mounted on the frame of the apparatus, the tongs being operatively associated with each pulley means and the pulley means being interconnected by cable means extending between the pulley means in a general figure eight configuration. Through this mechanism, one rotation of one pulley means—as by a fluid pressure cylinder—produces counter rotation of the other pulley means.

Other objects and advantages of the invention may be seen in the details of the ensuing specification.

DETAILED DESCRIPTION

The invention is described in conjunction with the accompanying drawing in which FIG. 1 is a front elevational view of apparatus embodying teachings of the instant invention;

FIG. 2 is a top plan view of the apparatus of FIG. 1;

FIG. 3 is a side elevational view of the apparatus of FIG. 1;

Figure 4:
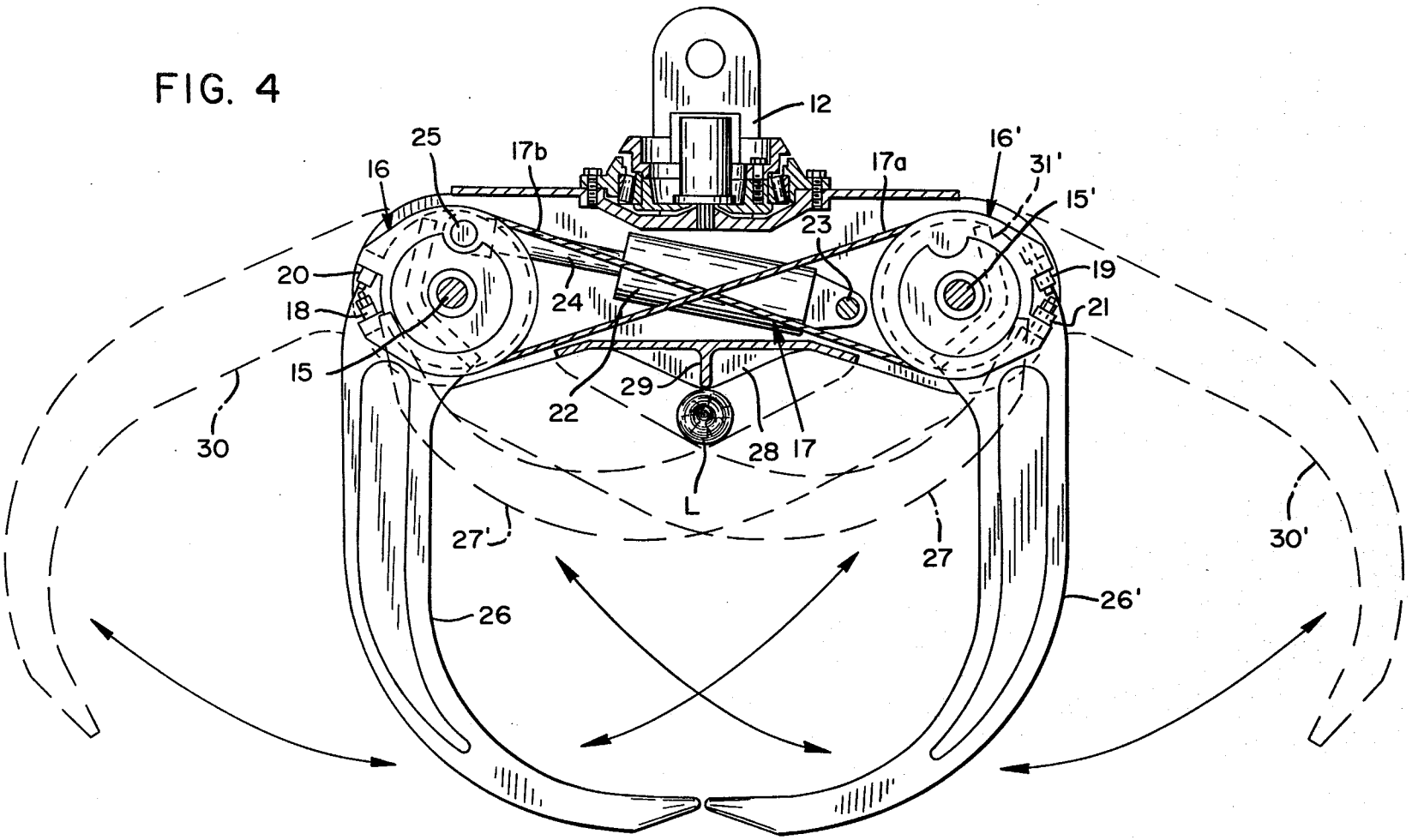
FIG. 4 is a view essentially similar to FIG. 1 but being partially in section and showing the grapple with its tongs in different operating modes in dotted lines.

In the illustration given and with reference to the first sheet of the drawing, the numeral 10 designates generally a U-shaped frame which has affixed to the top wall 11 a swivel mechanism 12 suitable for connection to a hoist or the like (not shown). The details of one preferred form of swivel can be seen in the sectional view of FIG. 4.

The U-shaped frame 10 is equipped with a pair of depending walls 13 which are apertured as at 14 and 14' for the rotatable mounting of shafts 15 and 15', respectively. Carried by each shaft 15 and 15' for rotation relative to the frame 10 is a pulley means generally designated 16 and 16', respectively. The details of the pulley means 16, 16' can be better seen in FIG. 4.

The pulley means 16, 16' are interconnected by cable means generally designated 17 (see the central portion of FIG. 1) which are arranged in essentially a figure eight configuration. As can be best appreciated from a consideration of FIGS. 2 and 3, an even number of links of cable are employed being designated **17*a*, 17*b*, 17*c*, and 17*d*. These are arranged in two pairs with the cables in each pair being disposed in crisscrossed or figure eight fashion as can be best appreciated from a consideration of FIG. 4. For example, the cable link 17*a* is clamped at one end as at 18 to the pulley means 16 while the other end is clamped as at 19 to the second pulley means 16' (still referring to FIG. 4). In like fashion, the cable link 17*b* is clamped as at 20 relative to the pulley means 16 and as at 21 relative to the pulley means 16'**.

Figure 9:
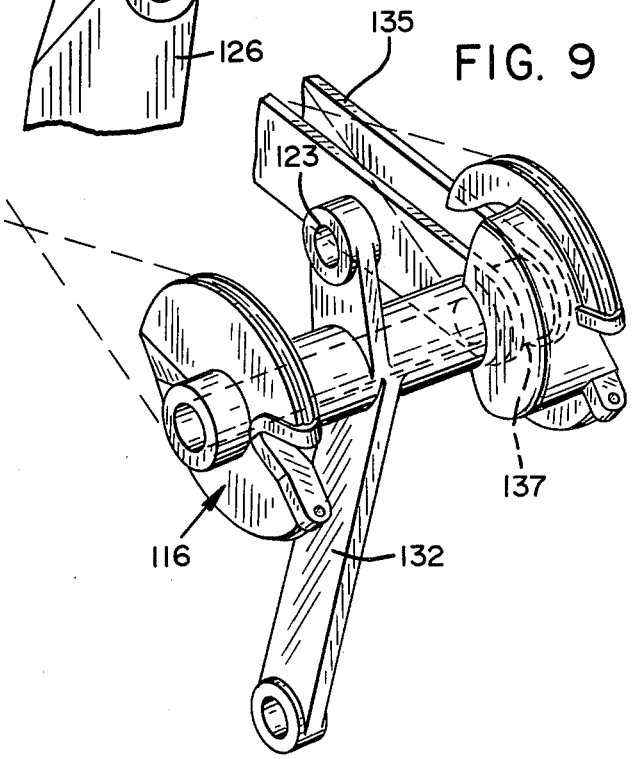
FIG. 9 is a fragmentary perspective view of one of the pulley means of the embodiment of FIGS. 5–8.

For this purpose, the pulley means 16, 16' has an interrupted periphery which can be appreciated from the perspective view of the pulley means 116 in the modified form of the invention presented in FIG. 9. In any event, the cable links are for illustration shown as **17*a*–17*d*** and are tension mounted on the pulley means. This assures that motion of one pulley means develops a corresponding motion of the other.

To develop motion of one pulley means as at 16, a fluid pressure cylinder 22 is pivotally mounted as at 23 (see the central portion of FIG. 1) on the frame 10. The cylinder unit 22 is equipped with the usual rod 24 which in turn is pivotally connected as at 25 to the pulley means 16. Thus, as the rod 24 is extended to rotate the pulley means 16 counterclockwise, the cable interconnection develops a clockwise movement in the pulley means 16'. This can be appreciated best from a consideration of FIG. 4 and with reference to the two tongs or tines 26 and 26' which are fixed relative to the pulley means 16, 16', respectively.

In FIG. 4, the solid line showing of the tongs 26, 26' corresponds to that of FIG. 1. As the rod 24 is extended further, the tong 26 moves into overlapping relation with the tong 26' and at maxim extension occupies the dotted line position designated 27 in FIG. 4. The same action moves the tong 26' to the position designated 27' in FIG. 4 so that in the "closed" position of the tongs as at 27, 27', the apparatus is able to tightly grip a log as at L which may be as small as 6" or less in diameter. For this purpose, each of the walls 13 is extended downwardly in a general V-shape as at 28, with the wall portions 28 being connected by a stiffening flange 29.

As the rod 24 is retracted, the tongs move from the 27, 27' positions through the positions designated 26, 26' and ultimately to the "open" position designated in dotted line and marked 30 and 30' in FIG. 4.

In brief, the assembly includes tongs pivotally connected at fixed points on a grapple head. A series of grooves are cast into the upper end of the tongs 26, 26' around the pivot point forming pulley means. Cables are wrapped alternately over one tong pulley means and under the other. This assures that the motion of one tong develops a corresponding motion of the other, each cable being anchored at both ends with an adjusting device provided at least at one end to assure uniform tension. The invention results in an assembly which carries more log capacity, is more flexible to variations in log size, i.e, it will keep them tight in the load so they won't slip out, and carries with a reduced height over conventional devices currently available.

For this embodiment, I prefer to utilize a unitary element for each of the pulley means 16, 16' along with the tongs 26, 26'. As can be appreciated from a comparison of FIGS. 3 and 4, the tong 26' (for example) is integral with the pulley means 16', having a flange part 31′ at its upper end. Multiple grooves (unnumbered) are provided for the cable links 17*a*–17*d*—see FIG. 3. These are arranged, as indicated previously relative to the cable links themselves, in pairs of grooves with the grooves in each pair being offset as can be best appreciated from a consideration of FIG. 3.

Figure 5:
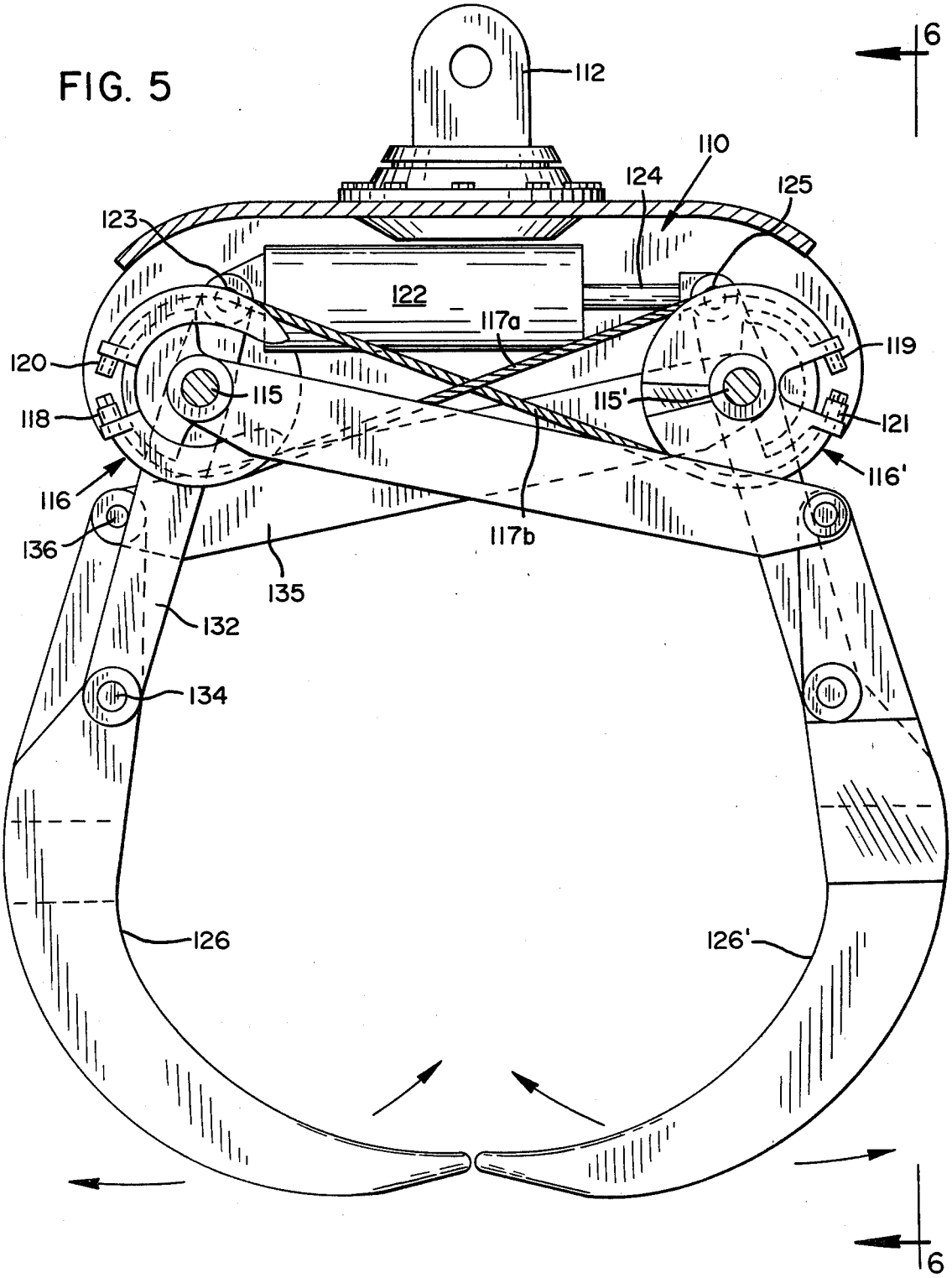
FIG. 5 is a front elevational view essentially similar to that of FIG. 1 but of another version of the invention.

A somewhat different form of pulley means of sheave is employed in the second embodiment of the invention as depicted in FIGS. 5–9. Where possible in these views, corresponding numerals are employed for corresponding parts but with the addition of 100 to the numeral. Thus, in FIG. 5, the numeral 110 designates generally the U-shaped frame which again is equipped with a swivel mounting as at 112. The pulley means are pivotally mounted relative to the frame and are generally designated 116 and 116′, being mounted, respectively, on shafts 115 and 115′. In FIG. 5, only two of the cable links are identified, these by the numerals 117*a* and 117*b*. The cable link 117*a* is equipped with a ferrule 119 at the end connected to the pulley means 116′ and with a tension adjusting device such as a threaded sleeve and ferrule as at 118 at the other end, i.e., the end connected to the pulley means 116. In the same fashion, the cable link 117*b* has a ferrule equipped end as at 120 connected to the pulley means 116 and the tension adjuster at 121 at the end connected to the pulley means 116′.

In the FIG. 5 showing, the piston rod 124 is pivotally connected as at 125 to the pulley means 116′ while the cylinder 122 is pivotally mounted on the opposite pulley means 116 as at 123 adjacent the pulley means 116. Again, the tongs are designated, now by the numerals 126 and 126′. In this embodiment however, instead of having the tongs rigidly connected to the pulley means, links are interposed to provide a motion multiplier. For this purpose, a motion multiplier link and reaction member are installed between the head and the tongs, the multiplier link being integral with the pulley means and the reaction member pivotal relative to the pulley means. These items provide for approximately but not exclusively a 2:1 angular motion multiplication between it and the tong (for each degree the link moves, the tong moves 2 degrees).

Figure 6:
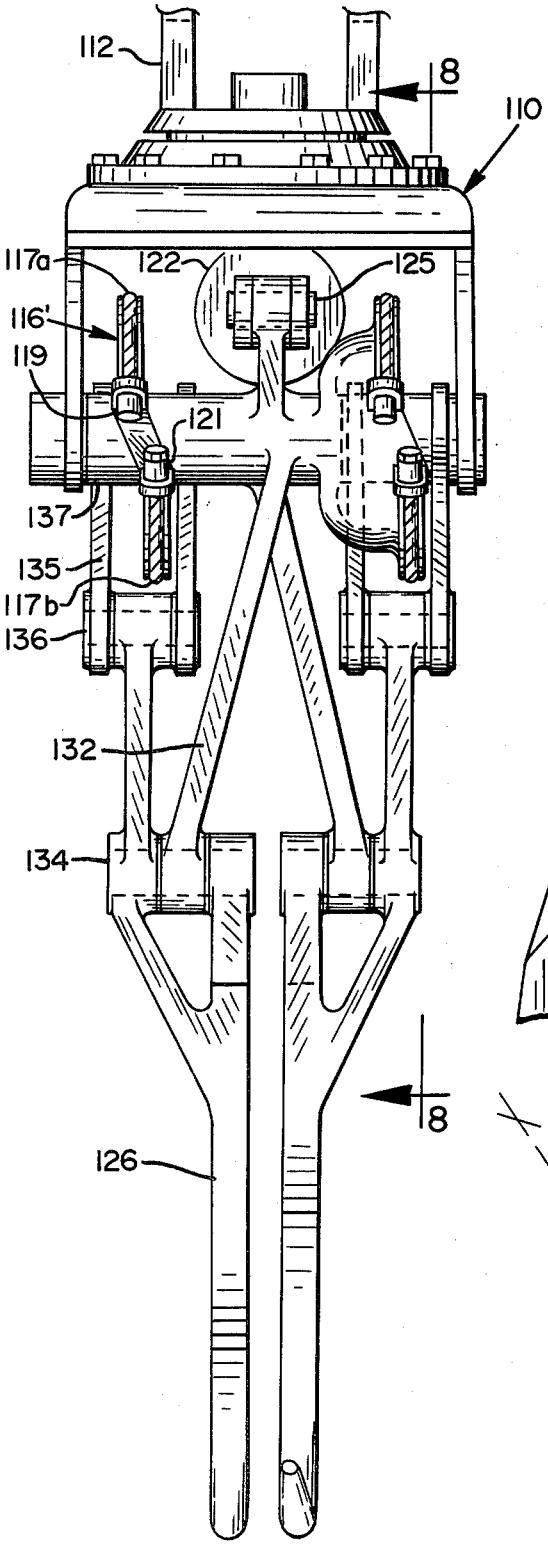
FIG. 6 is an enlarged framentary side elevational view of the grapple arrangement of FIG. 5 as seen along the line 6—6.
Figure 8:
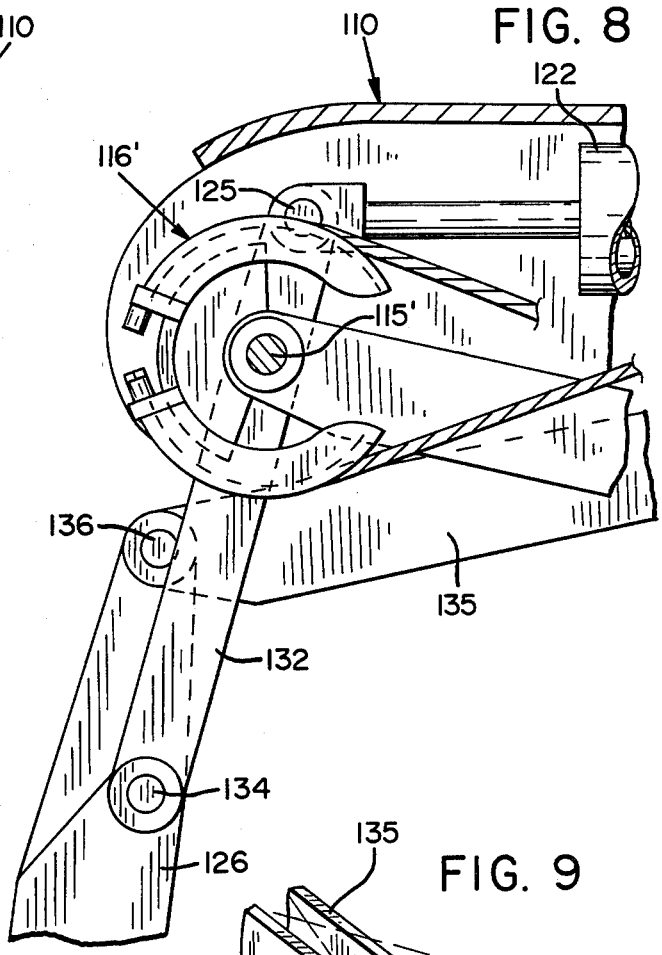
FIG. 8 is an enlarged fragmentary view of one of the pulley means and fragment of the tong and linkage of the grapple of FIG. 7 such as would be seen along the sight line 8—8 of FIG. 6.
Figure 7:
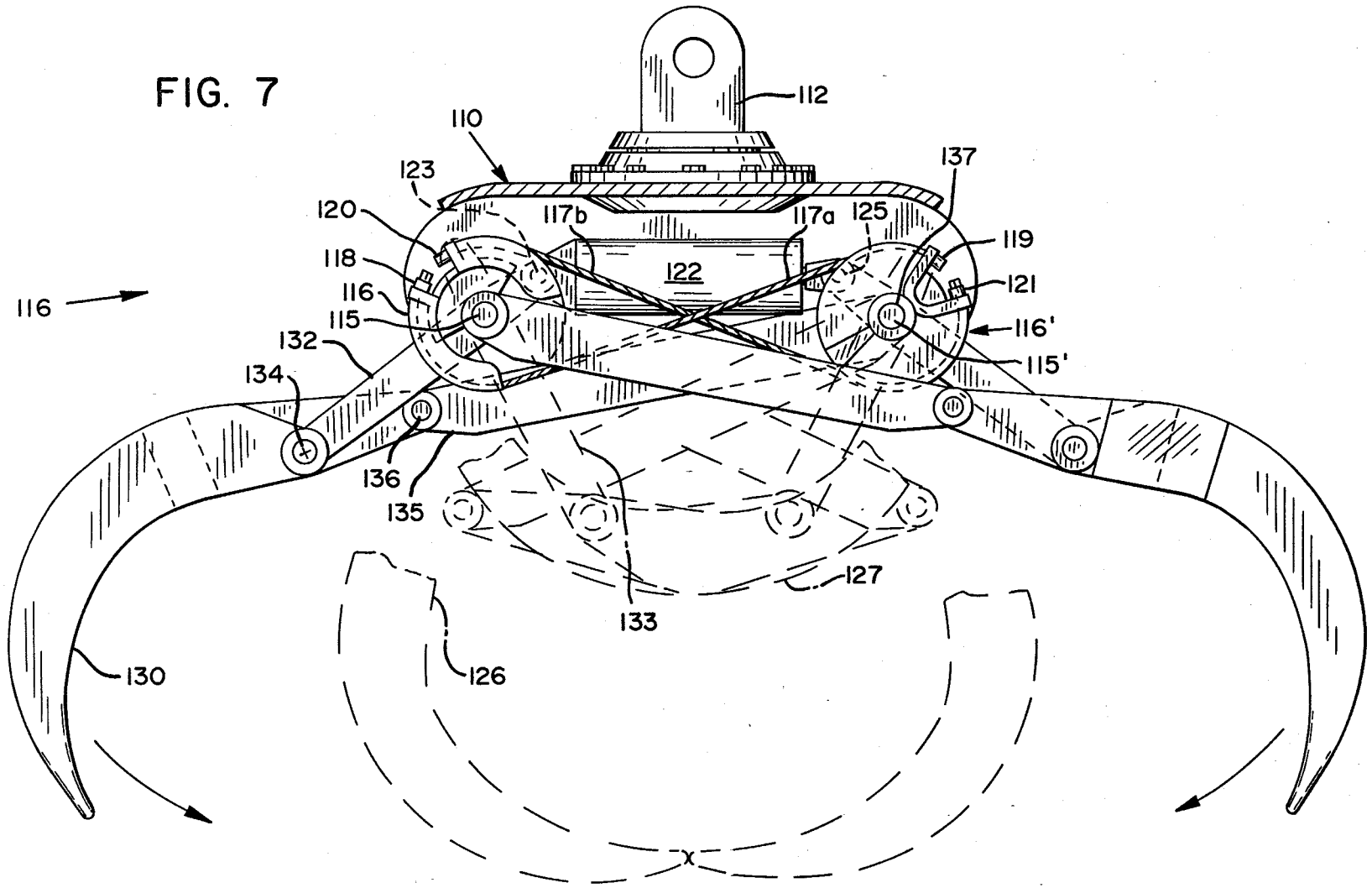
FIG. 7 is a view essentially similar to FIG. 5 but showing the tong elements in different operating modes.

As can be best seen in FIG. 7, the left hand motion multiplier link is designated 132 relative to the left hand tong—this being the tong 126 of FIG. 5 but in the wide open position designated 130 corresponding to that designated 30 in FIG. 4 relative to the first embodiment. In moving from the fully open position 130 through the "tip-to-tip" position 126 to the fully closed position 127, the motion multiplier link 132 moves from the solid line position to the dotted line position designated 133. This link also can be seen in FIG. 9 as well as FIG. 6. In FIG. 6, there is a pivotal connection as at 134 between the lower end of the motion multiplier link 132 and the tong 126.

The reaction member or link for the tong 126 is designated 135 and is also pivotally connected to the left hand tong (designated 130 in FIG. 7) as at 136. At its upper end, the reaction link 135 is pivotally connected to the opposite shaft as at 137 which also carries pulley means 116′. Thus, the multiplying linkage includes a pair of links for each tong, one each connected to each of the pulley means 116 and 116′ adjacent the upper end of each link 132, 135 and pivotally connected to the tong at the lower end as at 134 and 136. More particularly, the motion multiplier link 132 is connected to its associated tong (designated 130 in FIG. 7) a spaced distance below the upper end of that tong. On the other hand, the reaction link 135 is pivotally connected at the very upper end of the tong 130.

While in the foregoing specification a detailed description of the invention has been set down for the purpose of explanation, many variations in the details hereingiven may be made by those skilled in the art without departing from the spirit and scope of the invention.

I claim:

1. A mounting and actuating apparatus for the tongs of a grapple or the like comprising a frame having a pair of spaced apart pulley means rotatably mounted therein, fluid pressure cylinder means on said frame connected to one of said pulley means, cable means connected to said pulley means in tensioned condition and extending between said pulley means in general figure eight configuration whereby rotation of one pulley means by said cylinder means produces synchronized counter-rotation of the other pulley means, and identical tong means operably associated with each pulley means, each pulley means including a sheave member equipped with axially offset grooves to accommodate said cable means, said cable means including offset cable links, each link having an end secured to each sheave member, said fluid pressure cylinder means being pivotally mounted on said frame between said sheave members.

2. A mounting and actuating apparatus for the tongs of a grapple or the like comprising a frame having a pair of spaced apart pulley means rotatably mounted therein, fluid pressure cylinder means on said frame connected to one of said pulley means, cable means connected to said pulley means in tensioned condition and extending between said pulley means in general figure eight configuration whereby rotation of one pulley means by said cylinder means produces counter-rotation of the other pulley means, and tong means operably associated with each pulley means, said tong means including a multiplying linkage including a pair of links for each tong means, one link of each pair being connected to one of said pulley means adjacent said one link end and a grapple member connected to the other end of said one link, each pair of links including a multiplier link connected at one end to a first of said pulley means for rotation therewith, the other end of said multiplier link being pivotally connected to a first of said grapple members a spaced distance from the end thereof adjacent said first pulley means, a second of said pair of links being a reaction link mounted adjacent one end thereof in pivotal, coaxial relation to the second of said pulley means and at the other end thereof pivotally connected to said first grapple member at said adjacent end.

3. A mounting and actuating apparatus for the tongs of a grapple comprising a generally U-shaped frame providing a top wall and depending sidewalls, swivel mounting means on said top wall, a pair of spaced apart pivot shafts rotatably mounted in said sidewalls in spaced apart relation, one pivot shaft on each side of said swivel means, pulley means on each shaft rotatably mounted relative to said frame and equipped with a plurality of cable-receiving grooves therein, said grooves being spaced along the axis of said pivot shaft, a first cable link in wrapping relation to the top of one pulley means and secured thereto and in wrapping relation to the bottom of the other pulley means and secured thereto, a second cable link being axially offset from said first cable link and disposed in wrapping relation to the top of said other pulley means and secured thereto and in wrapping relation to the bottom of the first mentioned pulley means and secured thereto, said cable links being equally tensioned so that rotation of one pulley means develops corresponding and reverse rotation in the other pulley means, a fluid pressure cylinder means pivotally mounted on said frame, between said pivot shafts and eccentrically connected to one of said pulley means for rotating both pulley means in synchronism, and identical tongs fixed to said pulley means for rotation therewith.

4. The structure of claim 3 in which each pulley means has four cable-receiving grooves arranged in two pairs of two grooves each, said pairs of grooves being axially spaced apart and said fluid pressure cylinder means being connected to said one pulley means between said spaced pairs of grooves, each pair of grooves having associated therewith both a first and a second cable link.

5. The structure of claim 4 in which each pulley means groove is equipped with a notch accommodating the receipt of means for securing the end of a cable link, said securing means at least at one end of each cable link being arranged and constructed to adjust the tension in its associated cable link.

* * * * *